US005697131A

United States Patent [19]

Hunt et al.

[11] Patent Number: 5,697,131

[45] Date of Patent: Dec. 16, 1997

[54] MONEY CLIP

[76] Inventors: Gerald S. Hunt, 222 E. 3050 North, Ogden; Albert Sanone, 301 W. Pleasant View Dr., Pleasant View, both of Utah 84414

[21] Appl. No.: 659,003

[22] Filed: Jun. 4, 1996

[51] Int. Cl.[6] ..... A44B 21/00; B42F 1/00

[52] U.S. Cl. ..... 24/563; 24/67.9; 24/336; 24/338

[58] Field of Search ..... 24/563, 545, 67.9, 24/336, 3.12, 17 B

[56] References Cited

U.S. PATENT DOCUMENTS

| | | | |
|---|---|---|---|
| 1,493,072 | 5/1924 | Fricker | 24/563 |
| 1,621,008 | 3/1927 | Fricker | 24/563 |
| 1,675,286 | 6/1928 | Valkenburg | 24/563 |
| 1,828,417 | 10/1931 | Keleher | 24/338 |
| 2,729,868 | 1/1956 | Manning | 24/545 |
| 3,513,806 | 5/1970 | Ferrick | 24/336 |
| 4,226,006 | 10/1980 | Toyama | 24/563 |
| 5,002,249 | 3/1991 | Meyer | 24/67.9 |
| 5,309,605 | 5/1994 | Sato | 24/563 |

*Primary Examiner*—Victor N. Sakran
*Attorney, Agent, or Firm*—Broadbent, Hulse, Pierce & Pate

[57] ABSTRACT

A money clip having greater resilience without yielding by using a thin, stiff material. The clip may have a base and a lever, the lever being connected to the base by a spring, subject to bending deflection in use. The clip provides a reverse bend, or knee between the principal bend at the back of the clip, and a lip at the front of the clip. A long tongue extends as part of a base, extending out from the front of the clip where the lip contacts the tongue along a contact line. Near the back of the clip, the spring is formed as a loop having a diameter greater than the throat formed by the lever and base at their greatest distance from one another. The throat provides greater leverage on money held in the clip than does the lip, but both provide significant force to secure money without yielding the spring or lever, and without allow the money two turn, twist, or slide. A single bill, or fifty bills may be inserted into the clip with a totally elastic response by the clip.

18 Claims, 2 Drawing Sheets

MONEY CLIP

BACKGROUND

1. The Field of the Invention

This invention relates to jewelry and personal accessories, and, more particularly, to money clips.

2. The Background Art

Money clips, paper clips, binder clips, and a host of other re-usable, removable clamps and clips exist. Many clips have very specialized purposes. Clips may function well in an application for which they are designed. On the other hand, many clips are adapted to uses other than those for which they are designed with equal ease. By the same token, many clips operate only marginally well for the tasks to which they were specifically adapted. Money clips seem to fit into this last category.

One difficulty with money clips is the extreme variation in the conditions to which they are exposed. For example, a money clip may be used to hold a single paper bill folded in half. In this circumstance, many money clips do not exert sufficient force to hold the bill in the clip.

Money clips typically have a base portion that is more-or-less flat. Connected at one end of the base is usually a clamp or lever. Levers vary in sophistication, complexity, shape, material, and the like. A clip designed to provide proper force, contact force, on a bill clamped between the lever and the base, may be designed.

However, users of money clips often put many bills into the clip. A wad of 20 to 40 bills is not uncommon. After a clip, or, more properly, the lever of a clip has been extended to accept a large stack of bills, the connection between the lever and the base is usually yielded. Sometimes this is referred to as having sprung the clip. Upon yielding, the material of a clip has moved from the mechanical elastic stress range to the plastic range.

Therefore, the clip takes on a permanent set, a new shape. The material may have the same strength and the same mechanical spring constant. Nevertheless, the lever will be displaced, and the contact force on a small stack of bills will be substantially reduced, if extant. That is, upon yielding, money clips often are sprung to a slightly open position. Thus, the lever will exert no force on a stack of less than some number of bills amounting to some minimum thickness. Because the lever no longer contacts the base, the lever must be deflected away from the base a sufficient distance to give rise to a force corresponding to the deflection of the lever from the base.

Many individuals do not find a wallet a convenience. Money may not be kept in a wallet. Credit cards may not be kept in a wallet. Oftentimes, credit cards and cash are kept in a money clip. Cash and credit cards may be kept in separate money clips. Although credit cards are not folded, their securement in a clip is important. Likewise, day planners, day books, folders and the like are oftentimes used for organizing materials, including money, credit cards and the like. A clip suitable for inclusion in such a book is also desirable.

Because money clips tend to be spring easily, some users estimate that 90 to 98% of all money clips manufactured are not in use. People who seriously need functional money clips often feel relegated to using elastic bands to hold money. Money clips will not hold more than a relatively few bills consistently, without losing its spring. As a money clip may be required to hold 1 or 30 (or more) bills, those available in the marketplace do not have the range of motion, nor the permanency of resilience required for such regular duty.

What is needed is a money clip having great resilience, adequate contact force, a wide range of motion, and, particularly, a very wide opening capacity for holding more than 30 bills, without yielding.

BRIEF SUMMARY AND OBJECTS OF THE INVENTION

In view of the foregoing, it is a primary object of the present invention to provide a highly resilient money clip.

It is another object of the invention to provide a money clip having a wide throat dimension between a lever and a base, between which money may be secured.

It is another object of the invention to provide a money clip having a high contact force exerted between a lever and a base, whether the money clip contains no bills, a single bill, or relatively many bills.

It is another object of the invention to provide a money clip adaptable to hold credit cards securely.

It is another object of the invention to provide a money clip having a large bend (spring) region effective to distribute the strain associated with deflection of the lever from the base of the money clip as originally formed.

It is an object of the invention to provide a money clip having a profile relatively close to that of its large contents, particularly avoiding a condition in which the mouth of the money clip may be wider than the throat where the lever joins to the base.

Consistent with the foregoing objects, and in accordance with the invention as embodied and broadly described herein, an apparatus is disclosed in one embodiment of the present invention as including a base against which a lever presses in spring-loaded contact. The base portion and lever portion may be formed of a single strip of relatively thin material, such as a spring steel. The material may have a relatively large spring constant.

A lip may be formed in a distal end of the lever. The distal end of the lever, and the closest portion thereto of the base may form the mouth of the clip. The lip, together with the portion of the base positioned opposite thereto may present a smoothly opening path into the mouth of the clip. A user may exert slight pressure normal to the base and away from the lip, while lifting the lip away from the base with a thumb or other digit. Alternately, a user may simply slide an object, such as a credit card or wad of bills along the base toward the lip. In this circumstance, the object itself may engage the lip, lifting the lip away from the base to admit the object into the clip. The object may then be slid into the mouth of the clip until stopped by the bend area behind the throat.

A throat or throat region may be thought of as the region away from the lip (near the receiving opening of the clip), where the lever portion connects to the bend portion via the intermediate spring portion. The base and lever portions may be connected together by a bend portion having an overly large radius extending beyond (outwardly from) a throat formed between the lever and base as each connects to the arcuate spring. The throat may be larger than the mouth, formed proximate a contact line between the lever and base, of the clip.

The bend portion may also include a knee, or knee bend. The knee bend may be formed in a direction opposite the principal bend, with respect to a largest surface of the strip of material. All bends may be formed in directions normal (orthogonal, perpendicular) to the largest surface. The largest surface may be thought of as a surface of a sheet, the surfaces connected proximate the largest surface being little more than a thin edge of the sheet like material of the clip.

For example, a ribbon-like band or strip of spring steel may be formed to have some suitable width for making a clip. The strip may be cut into lengths suitable for making clips. The individual lengths may be buffed or polished along their edges of least aspect (e.g. the thickness aspect) to form a smooth edge without burrs or sharp angles.

A method of making a clip may include forming a ribbon of a resilient material having a suitable mechanical spring constant, yield strength, and elongation prior to yielding. These terms are understood in the mechanical arts relating to material selection. A sufficiently thin ribbon may be desirable, since maximum strain (deflection) in a bending member will occur on the outermost (in the direction along the bending force) fiber (on the surface).

The ribbon may be yielded to form the bend by being bent over a mandrel. Some retaining member may be used to support the base on the bottom, the side away from the interior of the bend. The mandrel may be positioned on the top side (interior of the bend) of the base. A forcing member may then wrap the ribbon around the mandrel, bending the ribbon extending away from the base past the mandrel to form the bend portion.

In one embodiment, the bend portion may be formed in multiple bending operations. That is, a material having a relatively high spring constant, relatively thin thickness, relatively high yield strength, and relatively large deflection or strain prior to yield, will form excellent ribbon for clips, it will also not yield in service. It therefore will not yield during forming without being over-stressed, yielded locally around the mandrel. This may be done by using a mandrel of diameter substantially less than the desired radius of the bend. Thus, a series of yielding, bending, wrapping operations about the mandrel, each executed further away from the base, may result in a bend portion of suitable diameter.

One will note that a single bending operation will not achieve the proper result without some post-operation heat treating. For example, the angle of deflection through which the bend portion is to be yielded may correspond to a few times the angle through which the lever must be operable without yielding occurring in the bend portion. Moreover, the general bending of the lever portion around a mandrel, of size comparable to the bend diameter, toward the base portion could not result in any residual contact force therebetween or even contact between the base and the lever.

That is, the last residual elastic deflection available in the bend portion, even after yielding, would allow the lever to spring away from the base when released from the bending operation. Heat treating could relieve residual stress and permit contact at the expense of the needed force between the lever and the base. Thus, heat treating may be one method for obtaining proper shape, resilience, or spring constant, but may destroy the needed pre-load desirable in a lever pressing against a base at the mouth of a clip.

Thus, a series of bending operations about a mandrel of diameter substantially less than the desired bend diameter may be preferred. Each bending operation may occur at a longitudinal position along the length of the ribbon of material progressively farther from the base. The base may typically be a substantially straight portion of the clip.

A knee or knee bend may be made proximate the juncture of the bend portion and the lever portion of the clip. The knee may be thought of as a bend in the direction opposite the direction of the principal bend or the bend portion discussed above. In this case, direction is normal (perpendicular) with respect to the largest surface (hereinafter surface, as contrasted with the thin edge) of the ribbon. Thus, the knee may be formed around a mandrel positioned on the outside of the ribbon, where the inside is the surface on the interior of the bend portion.

The knee allows for additional pre-loading of the lever (also called clamp) portion of the clip. That is, the bend portion proximate the knee may actually extend closer to the base than otherwise, by virtue of the yielding at the knee. Meanwhile, the knee may be formed by some yielding locally in the knee area. However, this may provide residual stress in the knee tending toward yield stress, thus pre-loading the lever, and providing excellent gripping between the lever and base at the mouth of the clip.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 5, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
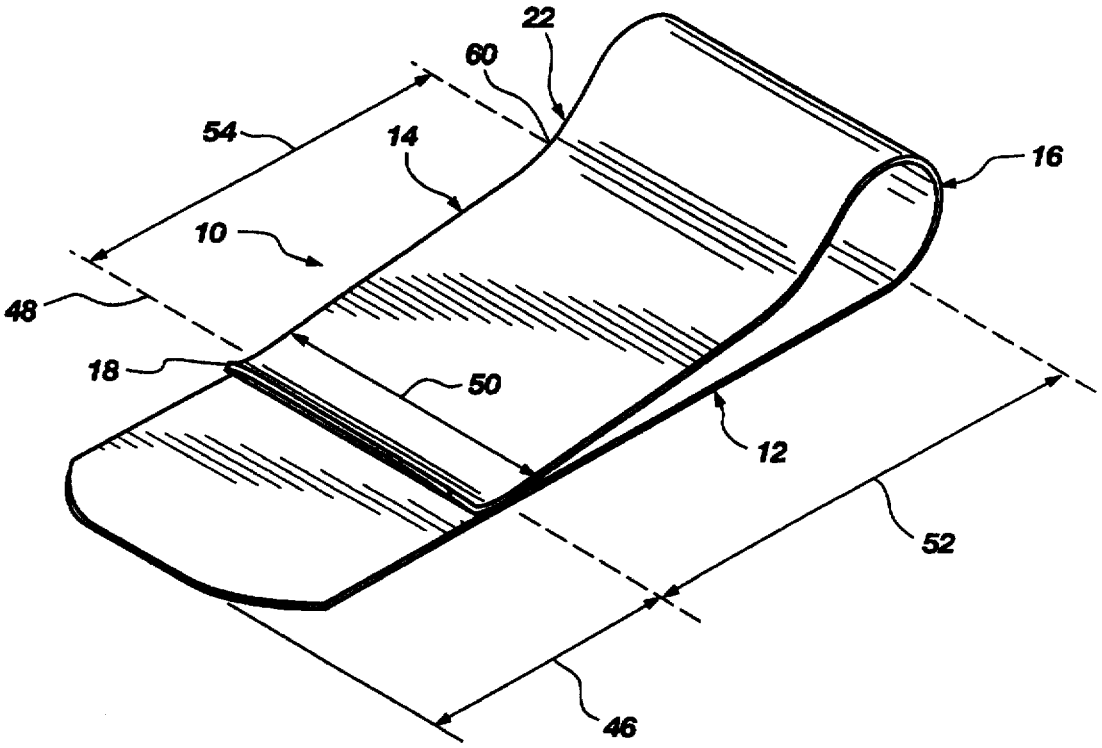
FIG. 1 a perspective view of an apparatus made in accordance with the invention.
Figure 2:
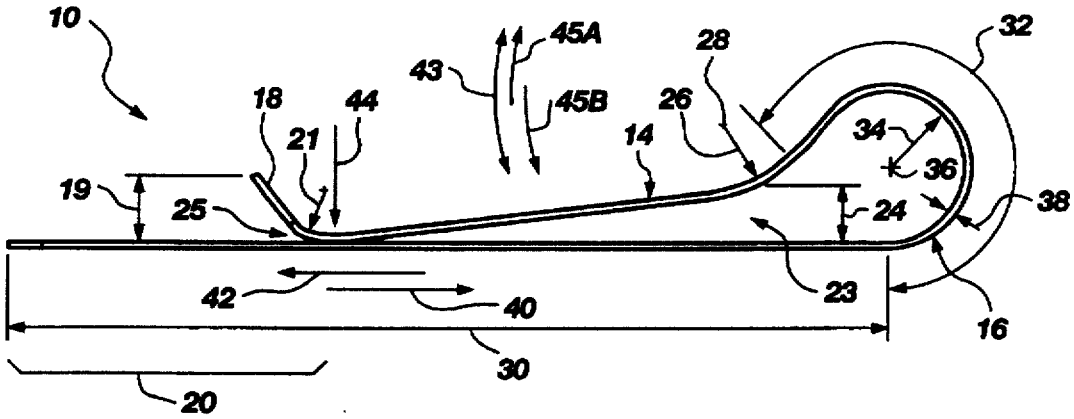
FIG. 2 is a side elevation view of the apparatus of FIG. 1.

Referring to FIG. 1, an apparatus 10 in accordance with the invention may be formed to have a base 12. The base 12 or base portion 12 may be formed to be disposed opposite a lever 14 or lever portion 14. The base 12 and lever 14 may be connected by a spring 16 (alternatively, bend 16).

In one embodiment of an apparatus 10 made in accordance with the invention, a base 12, lever 14, and spring 16 may be formed of a continuous band or ribbon of material. The material may be stainless steel, plastic, carbon steel or the like. Carbon steel has been found effective. In one embodiment BECU 25 steel under ASTM standard B194 has been used. In another method and apparatus in accordance with the invention, blue tempered carbon steel was used.

The lever 14 may be formed to have a lip portion 18. The lip portion provides for easy entry of objects such as money, credit cards, papers, or the like between the lever 14 and the base 12. The lip portion 18 may have a height 19 and radius 21 selected to provide for easy insertion of folded bills of money.

For example, the height 19 and radius 21, in one embodiment of an apparatus 10 made in accordance with an invention, are sized to urge the lever 14 away from the base 12, even when a stack of 20 or more folded bills are pushed against the lip portion 18 toward the spring 16. Thus, the tongue 20 readily separates from the lip 18 by application of a force in a backward direction 40.

The tongue 20 may be sized to provide sufficient area for engaging a stack of bills in order to be effective to permit a user to force an object (bills, cards, etc.) against the lip 18, lifting the lip 18 against a sprint force 44. The object may be thought of as forcing the base 12, including the tongue 20 away from the lip 18, thus easing insertion of bills through the mouth 25. The mouth 25, or mouth region 25, is formed by the base 12 and lever 14, when separated, at the contact line 48.

An object thrust against the lip 18 is captured between the lip 18 and tongue 20, permitting the object to slide through the mouth 25 and throat 23 to seat against the spring 16 at the back (direction 40) of the apparatus.

A knee 22 or knee portion 22 of the apparatus 10 may be formed between the spring 16 and the lever 14. The throat 23 may be formed by positioning the knee 22 some distance 24 or throat clearance 24 away from the base 12.

A knee radius 26 may be selected to provide a preferred throat clearance 24 in both a used and unused position of the apparatus 10. That is, the lever 14, in moving away from the base 12 moves the knee 22 some lesser distance away from the base 12. Accordingly, the knee radius 26 may be selected to effect the overall force 44 presented at the principal contact line 48 along the base 20. The knee radius 26 may be adapted to adjust such forces 44, as well as to adapt the throat clearance 24 to a desired distance.

The knee radius 26 and the effective knee center 28 or knee center 28 may be determined by the tool used to form the knee 22 in the apparatus 10. Similarly, the length 30 of the base 12 may be selected to provide more or less stiffness in the spring 16, and the lever 12 during use.

For example, it has been found that a length 30 that presents a tongue 20 relatively close to the lip 18 in a forward direction 42, may be more difficult to open. Similarly, a length 30 that presents a knee 22 relatively closer to the lip 18, also tends to be stiffer and more difficult to use, as compared to a longer length 30.

The spring 16 or bend 16 may be sized according to a desired circumference 32, corresponding to an arc angle 33, and radius 34. The arc angle may be thought of as 180° plus the angle between the tangents 35A, 35B to the lever 14 and base 12, respectively. Alternatively, the angle 33 is the angle swept by a radius between the center 36 or spring center 36 and the point of tangency 56, 58.

A circumference 32 may be selected for the spring 16. For example, a relatively longer circumference provides more material for deflection at smaller rates of deflection or strain. Therefore, a larger circumference 32 will provide more motion of the lip 18 and the tongue 12 without yielding any of the material on the apparatus 10, as compared with a shorter circumference 32.

Figure 3:
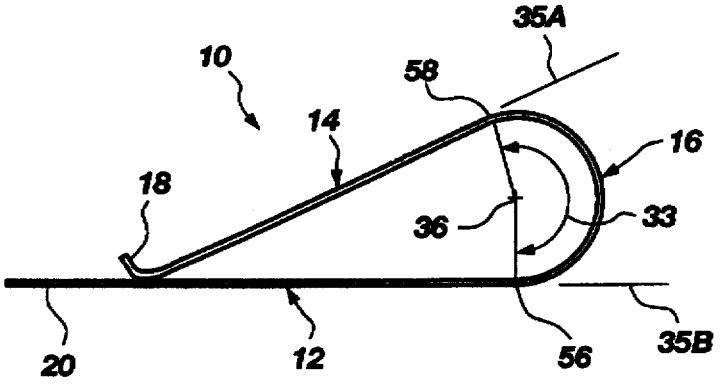
FIG. 3 is a side elevation view of an alternative embodiment for the apparatus of FIGURE 1.
Figure 4:
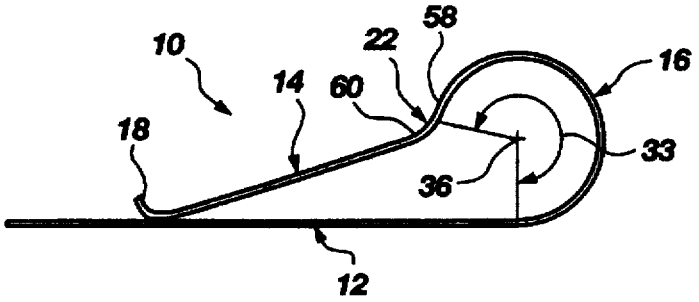
FIG. 4 is a side elevation view of an alternative embodiment of the apparatus of FIGURE 1.
Figure 5:
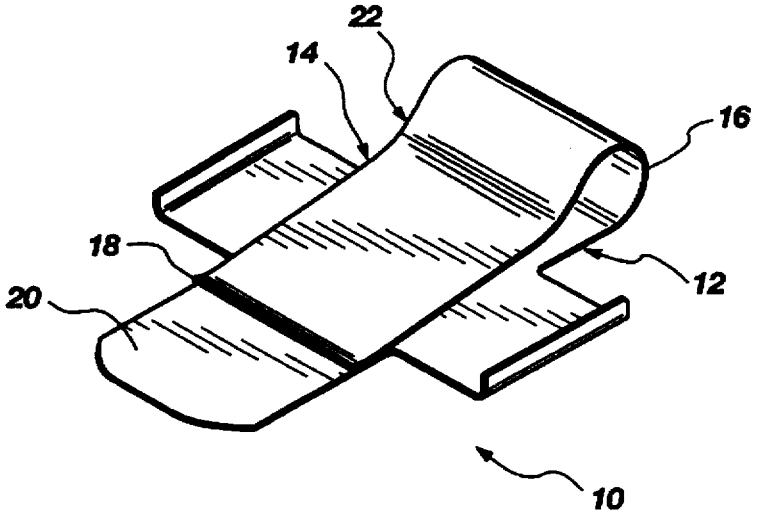
FIG. 5 is a perspective view of an alternative embodiment of an apparatus made in accordance with the invention.

One may note that the arc angle 33 spanned by the bend 16 or spring 16 may be slightly over 180° of angle, (see FIG. 3, or much larger (see FIG. 4). One benefit of a large arc angle 33 and large circumference 32 is distribution of strain. Strain is generally understood to be the displacement fraction for a displaced member. For example, a change in length (deflection) of an elastic member, divided by the initial length or other dimension may be defined as strain. Displacement may be thought of as the non-normalized deflection alone.

In bending, as with the spring 16 in use, the total deflection may be increased as the thickness 38 increases. Maximum stress and maximum strain, in bending, occur at an outermost fiber of the beam being bent. Therefore, yielding will occur first at the outermost fiber in bending.

Thus, in a prior art money clip, having a relatively larger thickness than the thickness 38 of the apparatus 10, yielding will occur sooner than in the apparatus 10, even if the same material were used in both devices. In one embodiment, a thickness 38 of 0.020 has been found to be effective in blue tempered carbon steel to form an apparatus 10 that may be opened to hold, without yielding, as large an object as the throat 23 will hold without yielding.

Force 44 exerted by the lever 14 may virtually always be available. The over-bending (local yielding) in the bend 16 and knee 22, may provide a pre-loading of the lever 14 against the base 12. A material may be selected according to ability to apply an appropriate force 44 at an appropriate thinness (thickness 38). Also a material may be chosen to have a sufficiently high yield strength to open both mouth 25 and throat 23 to hold 20 to 50 folded bills, in addition to a driver's license and credit card. A material may be selected to have a large spring constant appropriate to providing a proper preloading in the force 44 to hold a single bill or card.

Prior art devices have typically not had the capacity to hold a large object without yielding to the point of destroying contact at the contact line 18 between the lever 14 and the based 12. The above factors in addition to other dimensions may be selected for best service by the apparatus 10. For example, as an object (credit cards in a wad of folded bills) is moved in a backward direction 40, the force exerted by a user is normal (perpendicular) to the force 44, and in the backward direction 40.

The lip 18 responds with a force in the forward direction 42. The shape (curvature and height 18) of the lip contribute to capturing the entire object and resolving the forces to lift the lip 18. Prior art devices cannot typically capture such a large object, and may would not therefore be able to provide the lift.

That is, the lip 18 is free to move in a circumferential direction 43. The lip opens in an opening direction 45A, and closes in a closing direction 45B, as does the lever 14.

The lead length 46 also contributes to the opening process. That is, a lead length should be selected to provide some leverage in the closing direction 45B, which is effective for opening the mouth 25, if applied to the base 12. A lead length may also be advantageous if a user may place an object on the tongue 20 without any particular precision, and simply force the object toward the lip without snagging it, bending it, scraping it, or other wise engaging it on the edge of the tongue 20. Thus, a lead length adequate to place a thumb on comfortably is desirable.

The principal contact line 18 may preferably be provided with sufficient smoothness of curvature in the lip 18 to hold money without danger of ripping it. To this end, polished edges of the base 12 and lever 14 may be desirable also. However, the force 44 exerted along the contact line 48, the bearing width 40 of the apparatus 10, and the run 52 of the base 12 should be sufficient to reliably secure a single folded bill.

The force 44, in this circumstance, may be provided by proper selection of the material (spring constant) thickness 38, the run 52, the radius 34, the knee radius 26, and the arc angle 33 of the apparatus. In one currently preferred embodiment, using blue tempered carbon steel of 0.020 thickness, a length 30 of two and five eighths inches to the tangent point 56 was found satisfactory. A corresponding bearing width 50 of one inch was satisfactory, giving sufficient dimension that money cannot twist about the contact line.

The contact line may be spaced at one and a quarter inches lead length 46 for the tongue. The run 54 of the lever 14 may accordingly be one and an eighth inches, with a lip height 25 of three sixteenths of an inch. A 30 to 50 percent change, up or down, in each of the foregoing dimensions may provide satisfactory service, but the dimensions here have been found to be highly serviceable and aesthetically pleasing. The feel, action, capacity, appearance, and the like are highly suitable with the dimensions as described.

One may note that the tangent points 56, 58, 60 may be selected to alter the capacity of the throat 24. For example, the knee 22 has been made a straight angle in FIG. 3. However, this typically sacrifices some preload. In FIG. 4, the arc angle 33 is much greater, indicating that more of the material, in a longer circumference 32 has been yielded, providing more loading (bending stress) applied to the lever 14. In an equilibrium position, the base 12 may actually not be straight in some embodiments. Rather, the base may bow away from the lever 14, due to the force 44 applied by the lever at the contact line.

The knee 26, lip 18, material properties, thickness 38, radius 34, and bearing width 50 may be manipulated to obtain a proper loading range of several pounds of force, with a bias in the force 44 of from a few ounces to several (2–10) pounds. That is, even after receiving 100 layers of bill paper, and three credit cards, the full preload is still available for holding a single bill in the apparatus 10.

Manufacturing the apparatus 10 may be done by bending a ribbon of selected to shape and heat treating it to relieve stresses. Also, heating while bending may be used to provide yielding when needed. Plating and finishing may follow heat treating.

However, in one presently preferred embodiment, a ribbon of material such as stainless steel, blue tempered carbon steel, or the like may be sheared to length. The ends may be shaped, and the edges polished.

The lip 18 may be formed first for convenience in holding the work piece. The knee 22 bend may next be formed, by overbending (yielding) the material around a mandrel of radius less than the knee radius 26. The sizes of the mandrels may be altered to provide the shaping of the lip and knee. A smaller mandrel provides more yielding.

Different mandrel sizes may be used to form a single bend 18, 22, 16. That is, a bend need not be made in a single motion. Rather, a mandrel may be used once for a small portion of a bend, then moved a small distance along the bend and used again. By selecting sites close enough together and bending at correspondingly small angles on any single bending operation, smooth transitions may be provided for aesthetics (appearance) and functional benefits, such as smooth operation and evenly distributed stress and strain.

The bend 16 or spring 16 may then be formed by bending the work piece in a direction opposite (opposite sense) to that used for the knee 22. A mandrel of 3/16 inch diameter has been found satisfactory for forming the lip 18 and the knee 22. A mandrel of 1/4 to 5/16 inch diameter has been found effective for forming the spring 16 or bend 16. These mandrel sizes may be enlarged for a thicker material, and reduced for a thinner material. For example a 3/8 inch diameter mandrel functioned well with certain materials over the preferred 0,020 inch thickness 38.

A square, angular compression member may be brought to bear against the mandrel to bend the material. The compression member fits in section view as an angle around the circular mandrel section, wrapping the material against the mandrel to form each bend.

In the prior art, certain clips are formed directly for pens and the like. Also certain pocket-gripping devices such as eyeglass cases, pen holders, key clips, and the like are extant. Cold forming, into which category the foregoing description also fits, is sometimes used. However, forming a clip after covering it is apparently required. One reason for this is the difficulty of manufacturing a completed article having a covered clip internal to a product.

In the instant case, better control over shape and performance are available, providing a spring radius 34 of one half inch, able to hold the fold of a wad of bills without yielding the spring 16. The knee radius 26 from the knee center 28 may be from about a sixteenth to a quarter inch. In one embodiment, the knee may be a straight angle.

The lip 18 may be made with a short radius 21 of about a sixteenth to half an inch with good performance.

In use the money clip 10 or apparatus 10 may be used by folding one or more bills. Alternatively, a plurality of bills may also be folded over one or more cards. The cards may include, for example a driver's license, credit cards and the like. A golfer or tourist may not be dressed to carry a wallet or other bulky container for money or identification, for example.

After folding the bills, a user may force the folded edge of the bills against the tongue 20 and lip 18 of the apparatus 10. The lip 18 may then move outwardly 45A away from the base 12 and tongue 20, moving the lever 14 outwardly 45A. The user continues to move the bills backward 40 through the mouth 25 of the apparatus 10, along the base 12 and lever 14, and through the throat 23. The user seats the bills against the spring 16 at the back 40 of the apparatus.

A user may remove the bills by gripping the bills near the tongue 20 of the apparatus, and pulling in the forward direction 42. One will note that the throat provides tremendously more force on the bills than does the lever 14 along the contact line 48. That is, the leverage advantage of the spring 16 at the throat 23 is much more than that of the lever 14 at the contact line, without danger of yielding the apparatus 10.

This is in contrast to prior art devices in which a sufficient gripping force 44 at the contact line 48 is vitiated by the same thickness of bills in the throat. That is, the bills pushing against a lever that is at its narrowest point at all points backward 40 of the contact line 48, does not hold sufficient force 44 to prevent the money from slipping out of the clip near the mouth.

From the above discussion, it will be appreciated that the present invention provides a more serviceable clip than has heretofore been available. The thickness capacity, tenacity or force of securing an object, durability in service without yielding, and functional range of motion (from a single bill to large stacks of bills) are all beneficial features not available in money clips known in the art. A method of manufacturing such a clip, uses local yielding to provide a satisfactory shape. Meanwhile the method provides a proper level of pre-stress in lever of the clip. This pre-stress, or pre-load, assures a firm grip, yet smooth operation over a large range of object sizes. To provide these features in an apparatus manufactured by the disclosed method provides a superior product in service.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for holding an object, the apparatus comprising:

a continuous ribbon of metal having a base portion, lever portion, sprinq and a lip;

the base portion extending to support an object thereagainst;

the lever portion having a knee yielded to provide a substantial residual force therein for urging the object toward the base portion;

the lip formed proximate a distal end of the lever portion to curve away from the base for urging the lever portion away from the base portion in response to a user forcing the object toward the lip;

the spring portion yielded into an arcuate form extending between the lever portion and and the base portion to grip the object therebetween.

2. The apparatus of claim 1 wherein the spring portion is positioned to extend between a proximal end of the base portion and a proximal end of the lever portion.

3. The apparatus of claim 2 further comprising a knee portion positioned between the spring portion and the lever portion and formed in an arcuate shape curving away from an inside surface of the spring portion.

4. A money clip comprising:

a continuous ribbon of a resilient material having a base portion, lever portion, spring portion, and a lip;

the ribbon having first and second ends folded together to be positioned proximate one another, and having a length and width selected to provide a bearing width sufficient to secure an object;

the lip formed proximate the first end;

the lever portion being positioned proximate the lip and having a knee yielded to provide a substantial residual force therein;

the spring portion formed between the first and second ends and bent in a direction opposite that of the lip with respect to a first surface of the ribbon, the spring portion being yielded into an arcuate form extending between the lever portion and and the base portion to grip the object therebetween.

5. The apparatus of claim 4 further comprising a knee formed intermediate the lip and the spring to bend in the same direct as the lip, with respect to the first surface of the ribbon.

6. The apparatus of claim 5 further comprising a base portion extending substantially straight between the spring and the second end, the second end extending a distance beyond the first end.

7. The apparatus of claim 6 further comprising a clamp portion extending in a straight direction between the spring and the lip to form a throat spacing apart the base from the clamp proximate the spring.

8. The apparatus of claim 7 wherein the knee is a yielded portion of the ribbon.

9. The apparatus of claims 7 wherein the spring is a yielded portion of the ribbon.

10. The apparatus of claim 7 wherein the lip is a yielded portion of the ribbon.

11. The apparatus of claim 7 wherein the lip, the spring portion and the knee portion are respective yielded portions of the ribbon.

12. A clip formed from an elongate member having a first aspect ratio of length to width of from about 1 to 1 to about 8 to 1, and second aspect ratio of width to thickness of from about 25 to one to about 100 to one, the elongate member being folded into a clip comprising:

a base portion extending substantially flat away from a second end;

a lever portion extending substantially flat away from the first end, the first and second ends being positioned proximate one another;

a spring portion, curved and resiliently bendable to urge the first and second ends together at a force selected to secure an object therebetween, the spring portion being yielded into an arcuate form extending between the lever portion and and the base portion to grip the object;

a lip formed proximate the first end of the elongate member to extend from the lever to contact the base portion, the lip curving away from a contact line therebetween to contact the lever and to terminate in the first end, each spaced from the contact line, leaving a tongue portion of the base, extending beyond the lip;

the knee yielded into the elongate member to extend curvately between the lever and the spring to provide a residual pre-stress between the lip and the tongue portion, the knee curving in a direction opposite to a curvature of the spring.

13. The apparatus of claim 12, wherein the lever and the base, proximate the spring, are spaced apart to form a throat for receiving an object.

14. The apparatus of claim 13 wherein the throat is sized to hold at least ten folded bills of money without yielding the spring and without yielding the lever.

15. The apparatus of claim 14 wherein the throat is sized to hold at least 20 folded bills of money without yielding the spring and without yielding the lever.

16. The apparatus of claim 14 wherein the throat is sized to hold at least 50 folded bills of money without yielding the spring and without yielding the lever.

17. The clip of claim 13 wherein the lip formed to urge the lever away from the base whenever an object is forced toward the throat along the tongue and against the lip.

18. The clip of claim 17 wherein the throat is formed to permit the object to move through the throat to contact the spring.

* * * * *